US006885188B2

(12) United States Patent
Russell

(10) Patent No.: US 6,885,188 B2
(45) Date of Patent: Apr. 26, 2005

(54) DETECTOR ASSEMBLIES AND METHODS

(75) Inventor: Michael Russell, Cheltenham (GB)

(73) Assignee: Smart Stabilizer Systems Limited, Gloucestershire (GB)

( * ) Notice: Subject to any disclaimer, the term of this patent is extended or adjusted under 35 U.S.C. 154(b) by 176 days.

(21) Appl. No.: 09/931,552

(22) Filed: Aug. 16, 2001

(65) Prior Publication Data

US 2002/0078745 A1 Jun. 27, 2002

(30) Foreign Application Priority Data

Aug. 18, 2000 (GB) ..... 0020363

(51) Int. Cl.[7] ..... G01P 3/44

(52) U.S. Cl. ..... 324/166; 324/174; 33/352 R; 33/1 PT

(58) Field of Search ..... 33/352, 1 PT, 33/355 R; 324/207.11, 207.12, 207.14, 207.15, 207.2, 207.21, 207.22, 207.25, 166, 173, 174

(56) References Cited

U.S. PATENT DOCUMENTS 3,930,201 A * 12/1975 Ackermann et al. ..... 307/106
4,233,592 A * 11/1980 Leichle ..... 341/6
4,647,853 A 3/1987 Cobern ..... 324/166
5,228,349 A * 7/1993 Gee et al. ..... 73/862.336
5,302,893 A * 4/1994 Yoshimura ..... 324/207.22
5,719,496 A * 2/1998 Wolf ..... 324/165
6,617,980 B2 * 9/2003 Endo et al. ..... 340/905
6,651,496 B2 * 11/2003 Van Steenwyk et al. . 73/152.03

FOREIGN PATENT DOCUMENTS

GB 1 552 864 9/1979
GB 2 135 060 A 8/1984

* cited by examiner

*Primary Examiner*—Jay Patidar
(74) *Attorney, Agent, or Firm*—Drinker Biddle & Reath LLP

(57) ABSTRACT

The rotational position of a shaft (10) with respect to a sleeve (12) is determined by using a sensor (14) rotating with the shaft (10) to detect an earth vector such as magnetic or gravitational field, using a coil (18) on the shaft in conjunction with a plurality of ferromagnetic elements (16) on the sleeve to monitor relative rotation, and calculating the rotational position from these parameters. Applicable to downhole use, particularly gamma ray measurements.

11 Claims, 1 Drawing Sheet

DETECTOR ASSEMBLIES AND METHODS

FIELD OF THE INVENTION

Figure 1:
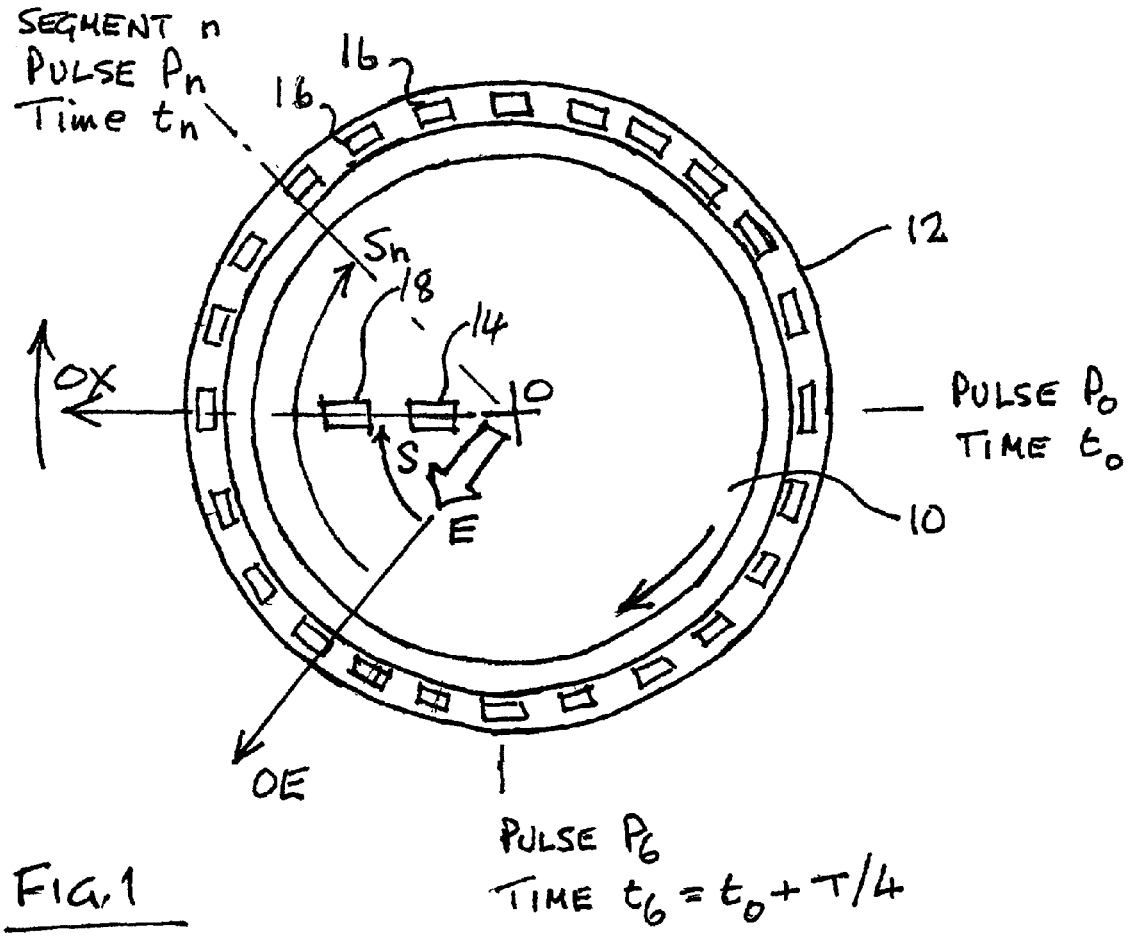

This invention relates to detector assemblies for use principally, but not exclusively, in well logging.

BACKGROUND OF THE INVENTION

The latest hydrocarbon production methods require that the production section of the well has a maximum possible length in the oil-bearing stratum. Since most oil-bearing production zones are substantially horizontal, this results in the final section of the well becoming appropriately horizontal. Although the general location of an oil-bearing stratum may be known prior to the drilling of a production well to tap the oil-bearing stratum, the position (in all dimensions) of the production zone is not initially known with sufficient accuracy to ensure that the well can be bored directly to the production zone. Accordingly, geological formation data are collected as the well is drilled, and the collected data are suitably analysed to derive the exact direction (in all three dimensions) along which the well is to be extended, particularly to ensure that the final (and usually horizontal) section of the well is in the best position for the recovery of oil. The procedure is known as "geosteering".

Geological formation data are commonly gathered by gamma logging, i.e. by a procedure in which the intensity of detected gamma radiation is utilised to deduce geological properties. (While the source of gamma radiation may be naturally occurring radioisotopes more or less distributed throughout surrounding geological formations, a more usual source of gamma radiation is a manufactured gamma source (e.g., a compact mass of cobalt-60) emplaced at a fixed or controllably variable depth in an adjacent well such that the gamma source radiates through the geological formations between the gamma source and a gamma detector in the production well being drilled).

In order to geosteer, directional logging is necessary. For example, the intensity of detected gamma radiation above the bore of the well being drilled may be compared with the intensity of detected gamma radiation below the bore in order to decide the direction and extent by which to deviate the inclination of the next section of well to be drilled.

A gamma radiation detector typically comprises an assembly of a gamma-sensitive crystal (which emits a visible photon in response to the impact of a gamma photon), a photomultiplier (which outputs an electrical pulse count proportional to the light output of the gamma-sensitive crystal which, in turn, is proportional to the intensity of incident gamma radiation), and a pulse counter to accumulate a count, over a fixed interval, of electrical pulses from the photomultiplier.

The gamma radiation detector can be made directionally sensitive by surrounding the gamma-sensitive crystal with a gamma radiation shield (e.g., a tungsten shroud), the shield having an aperture or window through which gamma radiation can reach the gamma-sensitive crystal but only from one direction.

In order to carry out directional gamma logging of the well, it is necessary to orient the shield window to a selected angle with respect to a notional vertical plane through the well bore, and obtain a series of gamma intensity readings at various such angles, thereby to obtain a polar survey of geological formations surrounding the location of the detector.

In prior art well-drilling operations, the gamma radiation detector was incorporated into a bottom-hole drilling assembly. Directional gamma logging required that normal rotation of the drill string had to be stopped, and the drill string manipulated to orient the window to the required series of angles. The prior art directional logging procedure was therefore time-consuming, and prevented drilling during logging. (Transmission to the surface of logging data was also time-consuming, being usually undertaken by inducing pressure pulses in the drilling mud).

There is therefore a requirement for a means of conducting well logging operations such as gamma logging during drilling.

As will be discussed below, gamma logging during drilling requires the establishment of the angular orientation of a downhole assembly about the borehole axis. There are other situations in which knowledge of this angular orientation is desirable, for example in operation of the controllable stabiliser described in EP-A-1024245. The present invention aims to provide a convenient means of doing so.

SUMMARY OF THE INVENTION

According to one aspect of the present invention, there is provided a rotary assembly comprising a rotatable shaft; a sleeve journalled on the shaft and adapted to be stationary during rotation of the shaft; an earth vector sensor mounted for rotation with the shaft, the earth vector sensor being responsive to a given physical parameter in a direction substantially radial to the shaft; and an orientation signal generator which comprises means for generating a pulse train representing rotation of the shaft relative to the sleeve as a predetermined number of pulses per revolution, and means for deriving from the pulse train and the output of the earth vector sensor the angle between the earth vector and a given position on the sleeve.

Preferably, the rotary assembly is a downhole assembly adapted to form part of a drill string, and the earth vector is the component transverse to the drill string axis in the vicinity of the assembly of the earth's local magnetic field or gravitational field.

The means for generating a pulse train preferably comprises a directional sensor arranged radially of the shaft and cooperating with a plurality of elements equispaced around the circumference of the sleeve. In a preferred embodiment, said elements are ferromagnetic segments, and the sensor is a coil; the ferromagnetic elements may suitably be 24 in number.

Said deriving means preferably operates to integrate the earth vector sensor output over each of a number of successive part-revolutions, for example quarter revolutions, of the shaft to provide a series of simultaneous equations, and solving these equations to provide an orientation angle for each of said plurality of elements with respect to the earth vector.

From another aspect, the invention provides a method of sensing the angular position of a rotary assembly which comprises a rotatable shaft and a sleeve journalled on the shaft and adapted to be stationary during rotation of the shaft; the method comprising sensing an earth vector along an axis transverse to and rotating with the shaft, generating a pulse train representing rotation of the shaft relative to the sleeve as a predetermined number of pulses per revolution, and deriving from the pulse train and the earth vector the angle between the earth vector and a given position on the sleeve.

DESCRIPTION OF PREFERRED EMBODIMENT

Figure 2:
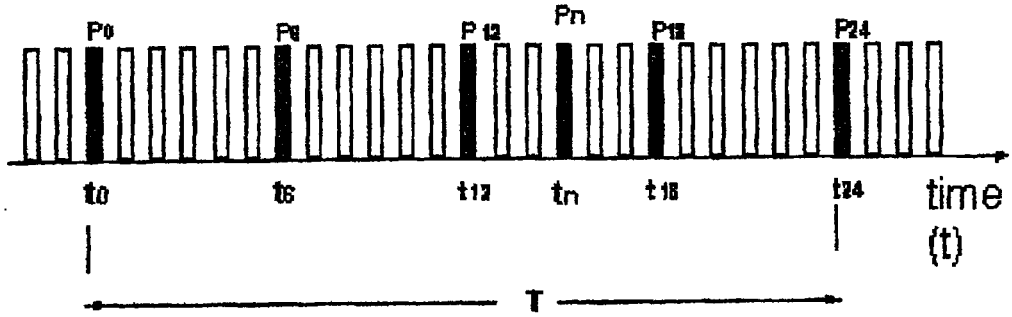

One embodiment of the first aspect of the invention will now be described, by way of example, with reference to the accompanying drawings, in which:

FIG. 1 is a schematic cross-section of part of a downhole rotary assembly; and FIG. 2 shows a pulse train produced in the assembly of FIG. 1.

Referring to FIG. 1, a shaft 10 forms part of a downhole assembly. A sleeve 12 is rotatable with respect to the shaft 10. In use, the sleeve 12 engages with a well bore and is rotationally stationary, with the shaft 10 rotating within it.

The assembly determines orientation by reference to an earth vector E, which is that component of the local earth magnetic field or local earth gravity acting at right angles to the shaft axis.

The assembly includes an earth vector sensor 14 mounted on the shaft for rotation therewith. The earth vector sensor 14 is a sensor for measuring the amplitude of the earth magnetic field or gravity along a rotating axis OX radial to the shaft.

The sleeve 12 is provided with a number (in this embodiment twenty four) of equally circumferentially spaced ferromagnetic segments 16, which cooperate with a pick-off coil 18 mounted on the shaft 10. The pick-off coil 18 is arranged, in this embodiment, to detect along the same axis OX as the vector sensor 14 but could be arranged on a different radius of the shaft 10 as long as the angle between the two detector axes is known.

The pick-off coil 18 produces a pulse train P0–P24 as illustrated in FIG. 2. The outputs of the earth vector sensor 14 and the pick-off coil 18 are processed as will now be discussed. It will be apparent to those in the art that the signal processing to be described can be effected by readily available electronic circuits or computers.

Earth Vector Sensor Output

If the (constant) angular velocity of the rotating shaft is W then $$W=d(S)/dt$$

If time=0 when (OX) is aligned with the Earth Vector Reference Direction (OE), then the Shaft Orientation Angle at any subsequent time t is given by $$S=\int_0^t W\cdot dt=W\cdot t$$

and the Segment n Orientation Angle Sn=W.tn

If the period of rotation of the drill sting is T then $$T=2\pi/W$$

With reference to FIG. 1, the magnitude of the sensed vector along the sensing axis direction (OX) at time t can be written as $$Ex(t)=E.\cos(W(t))+Ek$$

where E is the magnitude of the Earth Reference Vector {E} and Ek is a constant term provided that W is constant.

Thus, the sensing transducer output at time t can be written as $$Vx(t)=V.\cos(W.t)+Vk$$

where Vk is a constant term combining the transducer bias and the term Ek. V=SF.E where SF is the transducer scale factor (volts/g).

Earth Vector Sensor Output Integrations

If Pulse $P_0$ of FIG. 1 is an arbitrarily chosen pulse at some time to the repeated pulses $P_0$, $P_6$, $P_{12}$ and $P_{18}$ associated with times $t_0$, $t_0$+T/4, $t_0$+T/2, $t_0$+3T/4 respectively are used to control the integration of the sensing transducer output Vx(t) over 4 successive quarter periods of rotation starting at time $t_0$.

Consider the Integration of Vx(t) from any initial time $t_i$ to $t_i$+T/4

$$Q=\int_{t_i}^{t_i+T/4} V\cdot\cos(W\cdot t)\cdot dt+\int_{t_i}^{t_i+T/4} Vk\cdot dt$$

Thus, $$Q=[(V/W)\cdot\sin(W\cdot t)]_{t_i}^{t_i+T/4}+Vk\cdot T/4$$

or $$Q=(V/W).[\sin(W.t_i+W.T/4)-\sin(W.t_i)]+K \text{ or}$$

$$Q=(V/W).[\sin(W.t_i+\pi/2)-\sin(W.t_i)]+K \text{ or}$$

$$Q=(V/W).[\cos(W.t_i)-\sin(W.t_i)]+K \quad \text{(i)}$$

Where K is a constant=Vk.T/4

Using equation (i), the integration of Vx(t) from time $t_0$ to time $t_0$+T/4 yields $$Q1=(V/W).[\cos(W.t_0-\sin(W.t_0]+K \quad \text{(ii)}$$

Using equation (i), the integration of Vx(t) from time $t_0$+T/4 to time $t_0$+T/2 yields $$Q2=(V/W).[\cos(W.t_0+W.T/4)]-\sin(W.t_0+W.T/4)]+K \text{ or}$$

$$Q2=(V/W).[\cos(W.t_0+\pi/2)-\sin(W.t_0+\pi/2)]+K \text{ or}$$

$$Q2=(V/W).[-\sin(W.t_0)-\cos(W.t_0)]+K \quad \text{(iii)}$$

Using equation (i), the integration of Vx(t) from time $t_0$+T/2 to time to+3T/4 yields $$Q3=(V/W).[\cos(W.t_0+W.T/2)-\sin(W.t_0+W.T/2)]+K \text{ or}$$

$$Q3=(V/W).[\cos(W.t_0+\pi)-\sin(W.t_0+\pi)]+K \text{ or}$$

$$Q3=(V/W).[-\cos(W.t_0)+\sin(W.t_0)]+K \quad \text{(iv)}$$

Using equation (i), the integration of Vx(t) from time $t_0$+3T/4 to time $t_0$+T yields $$Q4=(V/W).[\cos(W.t_0)+W.3T/4)-\sin(W.t_0+W.3T/4)]+K \text{ or}$$

$$Q4=(V/W).[\cos(W.t_0+3\pi/2)-\sin(W.t_0+3\pi/2)+K \text{ or}$$

$$Q4=(V/W).[\sin(W.t_0)+\cos(W.t_0)]+K \quad \text{(v)}$$

Writing K1=V/W and $\alpha$=W.$t_0$ then equations (ii) through (v) yield for the four successive integrations of Vx(t)

$$Q1=-K1.\sin\alpha+K1.\cos\alpha+K \quad \text{(vi)}$$

$$Q2=-K1.\sin\alpha+K1.\cos\alpha+K \quad \text{(vii)}$$

$$Q3=K1.\sin\alpha-K1.\cos\alpha+K \quad \text{(viii)}$$

$$Q4=K1.\sin\alpha+K1.\cos\alpha+K \quad \text{(ix)}$$

Rotation Angles

Equations (vi) through (ix) can be solved to yield angle $\alpha$; there is a degree of redundancy in the possible solutions but, for example, $$Q1-Q2=2K1.\cos\alpha \text{ and}$$

$$Q3-Q2=2K1.\sin\alpha \text{ or}$$

$$\sin\alpha/\cos\alpha=(Q3-Q2)/(Q1-Q2) \quad \text{(x)}$$

Since $\alpha=W.t_0$ then $\alpha$ is the angle $S_0$between (OE) and the radius through the segment which activates pulse $P_0$, or the angle between (OX) and (OE) at the time $t_0$ when $P_0$ occurs, it follows that when Pulse $P_n$ occurs at time $t_n$ the angle between (OX) and (OE) is $$Sn=\alpha+n.2\pi/24 \quad \text{(xi)}$$

Thus, the segment orientation angles Sn for each segment are known and the corresponding pulses can be used to control events at known 15 degree ($2\pi/24$) rotating shaft orientation angles.

The foregoing embodiment may be incorporated in a controllable stabiliser apparatus as described in EP-A-1024245 to provide an orientation reference. In such use, the embodiment described may have an additional function. In EP-A-1024245 a controlled eccentricity is produced between the shaft 10 and the sleeve 12. By examining not only the timing but also the amplitude of the pulses P0–P24, the amount of eccentricity at any time can be determined.

The present invention in another aspect provides a well-logging procedure comprising the steps of providing a directional well-logging means in a bottom-hole assembly, the directionality of the logging means being substantially synchronous with rotation of the bottom-hole assembly, providing direction sensing means in the bottom-hole assembly for sensing the instantaneous direction of the bottom-hole assembly and hence of the well-logging means, providing a respective logging data reception means for each direction for which well logging is to take place, and switching the output of the well-logging means between appropriate ones of the logging data reception means according to the instantaneously sensed direction of the bottom-hole assembly whereby to accumulate directional logging data during rotation of the bottom-hole assembly.

The well-logging procedure may comprise the further step of subsequently transmitting accumulated directional logging data to the surface by utilising a data transmission means that does not require cessation of rotation of the bottom-hole assembly.

The invention in this further aspect may also be defined in terms of well-logging equipment comprising a rotatable bottom-hole assembly including a directional well-logging means whose directionality is substantially synchronous with rotation of the bottom-hole assembly, direction sensing means for sensing the instantaneous direction of the bottom-hole assembly and hence of the well-logging means, a respective logging data reception means for each direction for which well logging is to take place, and switching means for switching the output of the well-logging means between appropriate ones of the logging data reception means according to the instantaneously sensed direction of the bottom-hole assembly.

The bottom-hole assembly may further comprise data transmission means capable of selectively transmitting accumulated directional logging data to the surface, the data transmission means preferably not requiring cessation of rotation of the bottom-hole assembly.

The directional well-logging means may comprise a directionally sensitive gamma logger which is mounted within the bottom-hole assembly and is mounted non-rotatably with respect thereto. The gamma logger may be rendered directionally sensitive by being shrouded by a gamma radiation shield having a gamma radiation transmitting aperture therein.

The direction sensing means may comprise a geomagnetically sensitive magnetometer means operable to provide substantially instantaneous values for the bearing and azimuth of the bottom-hole assembly.

The well-logging equipment according to the second aspect of the present invention may be incorporated into a directionally-controlled eccentric as described in EP.A.1024245, preferably as part of the directionally-sensitive control system 18 of the exemplary embodiment as described with reference to FIG. 1 of EP.A.1024245.

Modifications and improvements of the above-described embodiments can be adopted without departing from the scope of the invention.

What is claimed is:

1. A rotary assembly comprising a rotatable shaft; a sleeve journalled on the shaft and adapted to be stationary during rotation of the shaft; an earth vector sensor mounted for rotation with the shaft, the earth vector sensor being responsive to a given physical parameter in a direction substantially radial to the shaft; and an orientation signal generator which comprises a plurality of elements equispaced around the circumference of the sleeve for generating a pulse train representing rotation of the shaft relative to the sleeve as a predetermined number of pulses per revolution, the orientation signal generator deriving from the pulse train and the output of the earth vector sensor the angle between the earth vector and a given point upon the sleeve.

2. A rotary assembly comprising a rotatable shaft; a sleeve journalled on the shaft and adapted to be stationary during rotation of the shaft; an earth vector sensor mounted for rotation with the shaft, the earth vector sensor being responsive to a given physical parameter in a direction substantially radial to the shaft; and an orientation signal generator which comprises a plurality of elements equispaced around the circumference of the sleeve for generating a pulse train representing rotation of the shaft relative to the sleeve as a predetermined number of pulses per revolution, the orientation signal generator deriving from the pulse train and the output of the earth vector sensor the angle between the earth vector and a given point upon the sleeve, wherein the earth vector is the component of the earth's gravitational or magnetic field along an axis perpendicular to the shaft axis.

3. An assembly according to claim 1 or claim 2, in which the orientation signal generator further comprises a directional sensor arranged radially of the shaft and cooperating with the plurality of elements.

4. An assembly according to claim 3, in which the directional sensor is a coil and the plurality of elements are ferromagnetic segments that cooperate with the coil to generate the pulse train.

5. An assembly according to claim 4, in which the ferromagnetic elements are 24 in number.

6. An assembly according to claim 2, wherein the orientation signal generator further comprises a directional sensor arranged radially of the shaft and cooperating with the plurality of elements, and operates to integrate the earth vector sensor output over each of a number of successive part-revolutions of the shaft to provide a series of simultaneous equations, and to solve these equations to provide an orientation angle for each of said plurality of elements with respect to the earth vector.

7. An assembly according to claim 6, in which said part-revolutions are quarter revolutions.

8. An assembly according to claim 6, in which said simultaneous equations are as defined in equations (vi) to (ix) below:

$$Q1=K1.\sin\alpha+K1.\cos\alpha+K \quad \text{(vi);}$$

$$Q2=K1.\sin\alpha-K1.\cos\alpha+K \quad \text{(vii);}$$

$$Q3=K1.\sin\alpha-K1.\cos\alpha+K \quad \text{(viii);}$$

$$Q4=K1.\sin\alpha+K1.\cos\alpha+K \quad \text{(ix);}$$

and wherein Q(n) are the earth vector sensor outputs, K1 and K are constants, and $\alpha$ is the orientation angle.

9. A downhole assembly according to claim 2, in which the sleeve forms part of a gamma ray detector that detects gamma radiation strength transverse to the drill string axis.

10. A method of sensing the angular position of a rotary assembly which comprises a rotatable shaft and a sleeve journalled on the shaft and adapted to be stationary during rotation of the shaft; the method comprising sensing an earth vector along an axis transverse to and rotating with the shaft, providing a plurality of elements equispaced around the circumference of the sleeve for generating a pulse train representing rotation of the shaft relative to the sleeve as a predetermined number of pulses per revolution, and deriving from the pulse train and the earth vector the angle between the earth vector and a given point upon the sleeve.

11. A rotary assembly comprising a rotatable shaft; a sleeve journalled on the shaft and adapted to be stationary during rotation of the shaft; an earth vector sensor mounted for rotation with the shaft, the earth vector sensor being responsive to a given physical parameter in a direction substantially radial to the shaft; and an orientation signal generator which comprises a plurality of elements equispaced around the circumference of the sleeve for generating a pulse train representing rotation of the shaft relative to the sleeve as a predetermined number of pulses per revolution, and means for deriving from the pulse train and the output of the earth vector sensor the angle between the earth vector and a given point upon the sleeve.

* * * * *